US008866074B2

(12) United States Patent
Okumura

(10) Patent No.: US 8,866,074 B2
(45) Date of Patent: Oct. 21, 2014

(54) TANDEM MASS SPECTROMETER AND MASS SPECTROMETRIC METHOD

(71) Applicant: Shimadzu Corporation, Kyoto (JP)

(72) Inventor: Daisuke Okumura, Mishima-gun (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 14/188,247

(22) Filed: Feb. 24, 2014

(65) Prior Publication Data

US 2014/0239170 A1 Aug. 28, 2014

(30) Foreign Application Priority Data

Feb. 26, 2013 (JP) ..... 2013-035707

(51) Int. Cl.
*H01J 49/04* (2006.01)
*H01J 49/02* (2006.01)
*H01J 49/00* (2006.01)

(52) U.S. Cl.
CPC ..... *H01J 49/005* (2013.01); *H01J 49/0031* (2013.01); *H01J 49/04* (2013.01)
USPC ..... 250/287; 250/281; 250/282; 250/283; 250/286; 250/290; 250/293; 250/294; 250/396 R

(58) Field of Classification Search
CPC ..... H01J 49/004; H01J 49/40; H01J 49/0036; H01J 49/0045; H01J 4/0031; H01J 49/0068; H01J 49/063; H01J 49/401; H01J 49/062; H01J 49/164; H01J 49/421; H01J 49/4225; H01J 49/424; H01J 49/0009; H01J 49/0027; H01J 49/0063; H01J 49/0081; H01J 49/0481; H01J 49/0495; H01J 49/061; H01J 49/42; H01J 49/4215; H01J 49/423; H01J 49/427; B82Y 30/00; B82Y 15/00; G01N 33/6848; G01N 33/6851; G01N 27/622; G01N 27/624
USPC ..... 250/281, 282, 288, 287, 286, 290, 283, 250/284, 289, 293, 294, 298, 396 ML, 424
See application file for complete search history.

(56) References Cited

U.S. PATENT DOCUMENTS 5,696,376 A * 12/1997 Doroshenko et al. ..... 250/292
6,107,623 A * 8/2000 Bateman et al. ..... 250/282
6,204,500 B1 * 3/2001 Whitehouse et al. ..... 250/287
6,285,027 B1 * 9/2001 Chernushevich et al. .... 250/287
6,507,019 B2 * 1/2003 Chernushevich et al. .... 250/287
(Continued)

FOREIGN PATENT DOCUMENTS

JP 2002-110081 A 4/2002

*Primary Examiner* — David A Vanore
(74) *Attorney, Agent, or Firm* — Sughrue Mion, PLLC

(57) ABSTRACT

An ion trap is provided between a collision cell and a time-of-flight mass separator. During a time period in which precursor ions derived from the same compound are selected with a quadrupole mass filter, a collision energy is changed from one to another. Various product ions that are produced by dissociation respectively under collision energies of the plurality of stages and precursor ions that are not dissociated are temporarily trapped in the ion trap, and are ejected in a packet form in the state where these ions are mixed, and are introduced into the time-of-flight mass separator 6 to be subjected to a mass spectrometry. Thereby, in a data processing unit, one MS/MS spectrum in which product ions produced in various dissociation modes under various CID conditions appear is created.

7 Claims, 5 Drawing Sheets

(56) References Cited

U.S. PATENT DOCUMENTS

| | | | | |
|---|---|---|---|---|
| 6,600,155 | B1 * | 7/2003 | Andrien et al. | 250/287 |
| 6,683,303 | B2 * | 1/2004 | Yoshinari et al. | 250/292 |
| 6,992,283 | B2 * | 1/2006 | Bateman et al. | 250/287 |
| 7,034,292 | B1 * | 4/2006 | Whitehouse et al. | 250/289 |
| 7,348,553 | B2 * | 3/2008 | Wang et al. | 250/282 |
| 7,365,312 | B2 * | 4/2008 | Laskin et al. | 250/282 |
| 7,507,953 | B2 * | 3/2009 | Makarov et al. | 250/287 |
| 7,544,931 | B2 * | 6/2009 | Yamaguchi et al. | 250/282 |
| 7,577,538 | B2 * | 8/2009 | Wang | 702/85 |
| 7,838,824 | B2 * | 11/2010 | Vestal | 250/287 |
| 7,851,751 | B2 * | 12/2010 | Bateman | 250/288 |
| 7,893,401 | B2 * | 2/2011 | Ding | 250/288 |
| 7,906,759 | B2 * | 3/2011 | Manri et al. | 250/282 |
| 7,919,745 | B2 * | 4/2011 | Shilov et al. | 250/281 |
| 7,928,363 | B2 * | 4/2011 | Bateman | 250/283 |
| 7,932,486 | B2 * | 4/2011 | Sano et al. | 250/281 |
| 8,119,982 | B2 * | 2/2012 | Kajihara | 250/282 |
| 8,384,024 | B2 * | 2/2013 | Miller et al. | 250/288 |
| 8,384,028 | B2 * | 2/2013 | Fujita et al. | 250/293 |
| 8,507,849 | B2 * | 8/2013 | Brown | 250/287 |
| 8,723,113 | B2 * | 5/2014 | Barofsky et al. | 250/294 |
| 2009/0179148 | A1 * | 7/2009 | Yasuda et al. | 250/282 |
| 2012/0292498 | A1 * | 11/2012 | Jiang et al. | 250/282 |

* cited by examiner

TANDEM MASS SPECTROMETER AND MASS SPECTROMETRIC METHOD

TECHNICAL FIELD

The present invention relates to a tandem mass spectrometer that dissociates an ion having a specific mass-to-charge ratio by Collision-Induced Dissociation (CID) or other methods, and performs a mass spectrometry of product ions (fragment ions) that are produced by the dissociation, and its mass spectrometric method.

BACKGROUND ART

In order to identify a substance with a large molecular weight and analyze the structure of the substance, an MS/MS analysis (or tandem analysis) is known as one of the mass spectrometric methods. In MS/MS analysis, an ion having a specific mass-to-charge ratio among various ions produced from a sample is selected as a precursor ion (which is the first stage mass separation), the precursor ion is dissociated by some method including one that brings the precursor ion into contact with a CID gas, and various product ions produced by the dissociation are separated according to the mass-to-charge ratios (which is the second stage mass separation) before they are detected.

A triple quadrupole mass spectrometer in which a collision cell is disposed between the quadrupole mass filters at a front stage and at a rear stage is a type of mass spectrometer capable of MS/MS analysis having a relatively simple structure which is widely used. Another configuration of a mass spectrometer is known in which the rear stage quadrupole mass filter of the triple quadrupole mass spectrometer is replaced with a time-of-flight mass spectrometer which has a higher mass resolution (see Patent Document 1, etc.). In the present description, a mass spectrometer that carries out two-stage mass separation as described above is called a tandem mass spectrometer. It is also called an MS/MS mass spectrometer.

In general, the dissociating pattern of a compound by CID or the like is not unique, and the same compound show different dissociating patterns depending on the CID conditions such as the magnitude of the collision energy given to the ions at the time of CID, and the gas pressure in the collision cell. This is because various bonding sites in a compound can be cut depending on the CID conditions. The main information that is obtained by the mass spectrum of MS/MS analysis is the information of masses of various fragments that are generated as the result of dissociation of the precursor ion derived from the target compound. Accordingly, in order to estimate the molecular structure of the target compound, it is more favorable if the mass information of a larger variety of fragments derived from the compound is obtained.

As previously described, in a tandem mass spectrometer, the dissociating pattern can be changed by changing the CID condition. Therefore, in the mass spectrometer described in Patent Document 1, MS/MS analyzes to the same sample are executed under the CID condition in which dissociation easily occurs and under the CID condition in which relatively less dissociation occurs, respectively, so that a highly fragmented mass spectrum and a less fragmented mass spectrum are acquired. In this case, the analyzer obtains more information by comparing both the mass spectra, for example, than in the case of simply using an Ms/MS spectrum under one CID condition, and can increase the estimating reliability of the structure of the target compound.

However, in the mass spectrometer described in Patent Document 1, only two kinds of information of the highly fragmented mass spectrum and the less fragmented mass spectrum can be obtained, and the mass spectrometer is not always sufficient for analyzing the structure of a compound having a complicated molecular structure. Though it is possible to modify the mass spectrometer described in Document 1 to acquire three or more MS/MS spectra with different CID conditions, it takes some time to perform a mass spectrometry over a certain range of mass-to-charge ratio, and therefore, the time needed to obtain a number of MS/MS spectra to one compound under different CID conditions becomes long correspondingly.

Especially when a gas chromatograph (GC) and a liquid chromatograph (LC) are connected to the front stage of the mass spectrometer, and compounds temporally separated by the chromatographs are analyzed by the mass spectrometer, the time width in which one compound is introduced in the mass spectrometer is significantly limited. Therefore, if the time required for analyzing one compound becomes long, the analysis will not finish in the time period in which the compound is introduced in the mass spectrometer. That is, the objective ions derived from the compound to be analyzed will be totally consumed before a plurality of mass spectra for the compound are fully obtained.

BACKGROUND ART DOCUMENT

Patent Document

[Patent Document 1] JP-A 2002-110081

DISCLOSURE OF THE INVENTION

Problems to be Solved by the Invention

The present invention has been developed to solve the aforementioned problems. The main objective of the present invention is to provide a tandem mass spectrometer that can collect a larger amount of product ion information in a short time period, and thereby can improve precision of analysis of a structure of a compound, and precision of identification of an unknown compound, and its mass spectrometric method.

Means for Solving the Problems

The present invention aimed at solving the aforementioned problems is a tandem mass spectrometer equipped with an ion source that ionizes a compound in a sample, a first mass separating unit that selects an ion having a specific mass-to-charge ratio in various produced ions as a precursor ion, an ion dissociating unit that dissociates the precursor ion, and a second mass separating unit and a detector that perform a mass spectrometry of various product ions that are produced by the dissociation, the tandem mass spectrometer including:

a) an ion mixing unit that is placed between the ion dissociating unit and the second mass separating unit, and adjusts traveling of ions so that ions are mixed together at least at a time point when the ions are introduced into the second mass separating unit, with respect to various ions ejected from the ion dissociating unit at different timings;

b) an analysis controlling unit that switches a condition under which the ion is dissociated in the ion dissociating unit from one to another, and controls an operation of the ion mixing unit so that the ions ejected from the ion dissociating unit during a time period of the switch are mixed together at least at the time point when the ions are introduced into the second mass separating unit; and c) a data processing unit that acquires a mass spectrum based on a detection signal that is obtained by the second mass separating unit and the detector in a predetermined mass-to-charge ratio range during the time period of switching the dissociation condition by the analysis controlling unit.

Further, the mass spectrometric method according to the present invention is a mass spectrometric method that uses a tandem mass spectrometer including an ion source that ionizes a compound in a sample, a first mass separating unit that selects an ion having a specific mass-to-charge ratio in various produced ions as a precursor ion, an ion dissociating unit that dissociates the precursor ion, and a second mass separating unit and a detector that perform a mass spectrometry of various product ions that are produced by the dissociation, the method including:

a) an ion mixing step of adjusting traveling of ions so that when a condition in which the ions are dissociated is switched from one to another in the ion dissociating unit, the ions that are ejected from the ion dissociating unit at different timings during a time period of the switch are mixed together at least at a time point when the ions are introduced into the second mass separating unit; and b) a data processing step of acquiring a mass spectrum based on a detection signal that is obtained by the second mass separating unit and the detector, in a predetermined mass-to-charge ratio range, with respect to the ions that are introduced into the second mass separating unit in a mixed state in the ion mixing step, during the time period of switching the dissociation condition in the ion dissociating unit.

The mass separating methods in the first mass separating unit and the second mass separating unit are not limited to specific ones. In a typical example, the first mass separating unit is a quadrupole mass filter, and the second mass separating unit is a time-of-flight mass separator. The method for dissociating an ion in the ion dissociating unit is not specifically limited, either. A typical example is a method using collision-induced dissociation (CID). In the case of dissociation by CID, dissociation of an ion is generally performed in a collision cell into which CID gas is introduced. The dissociation conditions include a collision energy that is given to a precursor ion, a gas pressure of the CID gas that is introduced into the collision cell, the kind of the CID gas and the like.

In the tandem mass spectrometer according to the present invention, in the state in which, for example, a target compound is introduced into the ion source, and the precursor ion having a specific mass-to-charge ratio corresponding to the compound selectively passes through the first mass separating unit, the ion dissociation condition in the ion dissociating unit is switched from one to another by control of the analysis controlling unit. In general, if the dissociation condition differs, kind and the production ratio of product ions produced from the same precursor ion change. Therefore, the kind of ions ejected from the ion dissociation unit is apt to change every time the dissociation condition is switched to a different dissociation condition, and the ion mixing unit adjusts traveling of the ions so that various ions ejected at such different timings are mixed together at least at the time point when the various ions are introduced into the second mass separating unit.

As one mode of the ion mixing unit that adjusts traveling of the ions like this, for example, an ion trap that temporarily traps ions can be used. The structure of the ion trap may be of a three-dimensional quadrupole type or may be of a linear type. The ion trap can temporarily traps incoming ions by the action of an electric field and other measures. Various ions are mixed together at the time of ion trapping, and these ions are ejected from the ion trap in the state in which various ions are mixed up, and can be delivered to the second mass separating unit.

In another mode of the ion mixing unit, an ion accelerating and decelerating device that performs either acceleration or deceleration, or both, to ions can be used. In response to a time difference of the ions that are ejected from the ion dissociating unit, for example, the ions that are ahead in terms of time are decelerated, and for the ions that come out later in terms of time, the deceleration degree of the ions is made smaller. In still another mode, the ions that are ahead in terms of time is not accelerated or decelerated, and an acceleration may be performed in such a manner that the acceleration degree for the ions that come out later in terms of time is increased more. In any case, by properly adjusting the degree of such acceleration or deceleration, the ions that come out later catch up with the ions that come out ahead of them from the ion dissociating unit at the time point when the ions reach the inlet of the second mass separating unit. Thereby, in the state in which various ions are mixed together, these ions can be delivered to the second mass separating unit.

The data processing unit acquires a mass spectrum based on the detection signal in the predetermined mass-to-charge ratio range that is obtained by the second mass separating unit and the detector during the time period of switching the dissociation condition as previously described. The ions that are the objects to be subjected to a mass spectrometry in the second mass separating unit and the detector are the ions in which the product ions produced under the different dissociation conditions are mixed together as previously described, and therefore, in the mass spectrum (MS/MS spectrum), various product ions that are not produced or hardly produced under one dissociation condition can be observed. Further, the product ions that are hardly produced under a specific dissociation condition can be observed with sufficient sensitivity. If the mass spectrum is the mass spectrum corresponding to one compound, the peaks that appear on the mass spectrum correspond to the fragments that are produced by cutting at various bonding sites of the compound. As a result, more fragment information can be collected than in the conventional mass spectrometer with respect to one compound, and therefore, the precision of the structure analysis of a compound and identification of an unknown compound can be improved.

In the tandem mass spectrometer according to the present invention, of course, the above-described analysis controlling unit may execute switch of the dissociation condition when driving the first mass separating unit in the selected ion monitoring (SIM) measurement mode with one precursor ion as a target. The analysis controlling unit also may execute switch of the dissociation condition when driving the first mass separating unit in the SIM measurement mode with a plurality of precursor ions as a target. In the latter case, the peaks of various product ions derived from different precursor ions overlay with one another in the mass spectrum, and by using the mass spectrum in which the peaks of the product ions derived from a plurality of precursor ions overlay with one another like this, as the reference mass spectrum that is used in structure analysis and identification of a compound, proper structure analysis and identification can be performed.

The tandem mass spectrometer according to the present invention may have a configuration further including a condition setting unit for setting in advance the dissociation condition that is switched from one to another in the analysis controlling unit in accordance with a compound to be analyzed.

According to the above configuration, when the dissociation condition under which a significant product ion peak does not appear for a certain compound is known in advance, other dissociation condition or conditions can be set by the condition setting unit. Thereby, an ion dissociation operation under insignificant dissociation condition can be omitted. Omittion of such insignificant dissociation operation leads to a reduction of the analysis time and improves the throughput, or enables an extension of the time period for the ion dissociation operation under another dissociation condition to perform analysis with higher sensitivity.

Further, in the tandem mass spectrometer according to the present invention, the above-described dissociation condition is set as a collision energy that is given to a precursor ion, and the above-described analysis controlling unit can switch the collision energy in a direction to be larger in sequence from a small energy.

The product ion that is produced by dissociation under a relatively low collision energy has a low speed, and on the other hand, the product ion that is produced by dissociation under a relatively high collision energy has a high speed. Therefore, if the collision energy is switched in such a manner that the energy becomes higher in sequence from a low energy, the distance in the flight direction of the product ions of the same kind that are produced under different energies is reduced. Thereby, speed adjustment of the ions with use of, for example, the ion accelerating and decelerating device is facilitated, and the state in which various ions coexist favorably can be brought about at the time point when the ions are introduced into the second mass separating unit without performing large acceleration and deceleration in the ion accelerating and decelerating device.

Effects of the Invention

With the tandem mass spectrometer and the mass spectrometric method according to the present invention, more fragment information can be collected with respect to one compound as compared with ordinary MS/MS analysis, and therefore, precision of the structure analysis of a compound and identification of an unknown compound can be improved. Further, the mass spectrum data with respect to various product ions that are produced under different dissociation conditions are acquired by performing a mass spectrometry one time, and therefore, the time required for mass spectrometry can be reduced. Thereby, even when the time period in which the target compound is introduced in the ion source is limited, for example, the information of various product ions derived from the compound can be collected without exception.

In general, the peak of the precursor ion sometimes does not appear on the mass spectrum at all depending on the dissociation condition. However, with the tandem mass spectrometer according to the present invention, by including such a dissociation condition that at least some of the precursor ions remain intact without being dissociated in a plurality of dissociation conditions, a mass spectrum in which both the precursor ion information and the product ion information are included can be acquired.

MODES FOR CARRYING OUT THE INVENTION

A tandem mass spectrometer that is the first embodiment of the present invention is hereinafter described with reference to the attached drawings.

Figure 1:
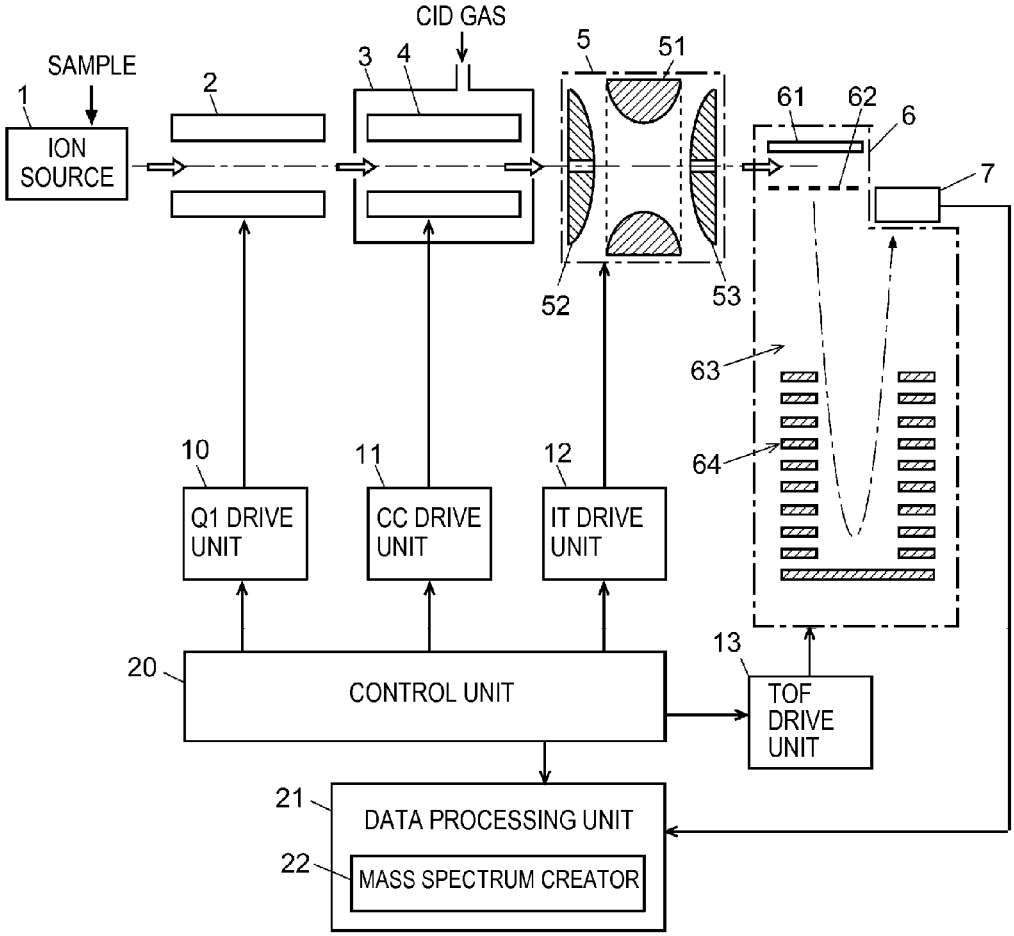
FIG. 1 is a schematic configuration diagram of a tandem mass spectrometer according to the first embodiment of the present invention.
Figure 2:
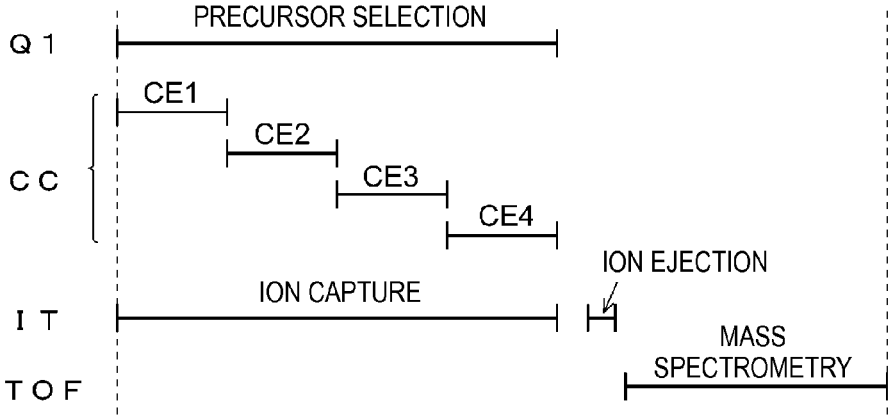
FIG. 2 is a schematic diagram showing schematic operation timings of an operation and processing for ions of respective units in the tandem mass spectrometer of the first embodiment.
Figure 3:
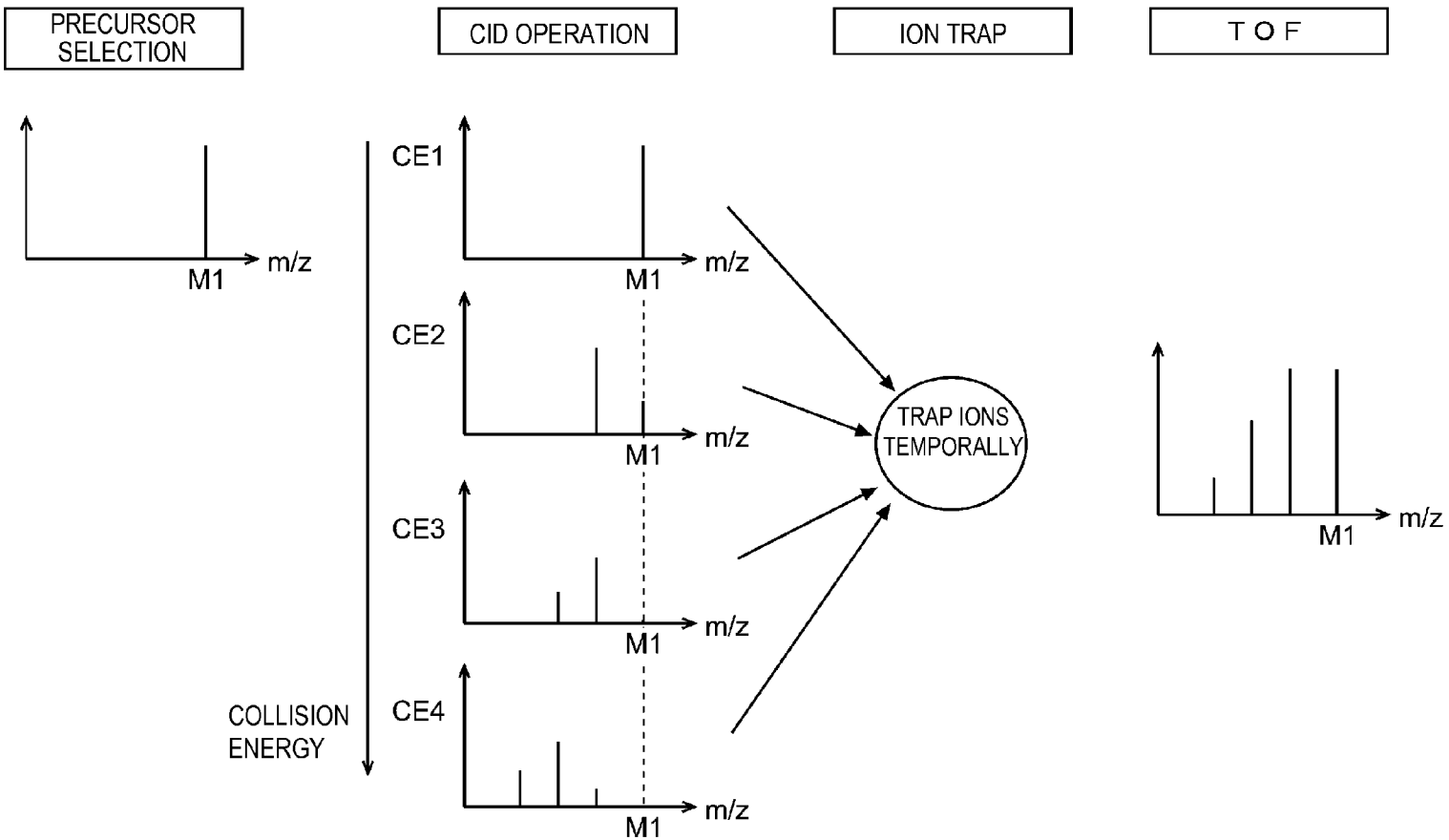
FIG. 3 is an operation explanatory diagram in the tandem mass spectrometer of the first embodiment.

FIG. 1 is a schematic diagram of the tandem mass spectrometer according to the first embodiment. FIG. 2 is a schematic diagram showing schematic operation timings of an operation and processing for ions of respective units in the tandem mass spectrometer of the first embodiment. FIG. 3 is an operation explanatory diagram in the tandem mass spectrometer of the first embodiment.

The tandem mass spectrometer of the first embodiment includes, within a vacuum chamber not illustrated, an ion source 1, a quadrupole mass filter 2 that corresponds to a first mass separating unit in the present invention, a collision cell 3 which an ion guide 4 is placed within, that corresponds to an ion dissociating unit in the present invention, an ion trap 5 that corresponds to an ion mixing unit in the present invention, a time-of-flight mass separator 6 of an orthogonal acceleration reflectron type that corresponds to a second mass separating unit in the present invention, and an ion detector 7. Note that ion optical elements such as an ion guide and an ion lens for efficiently transporting ions to a rear stage are usually provided between the ion source 1 and the quadrupole mass filter 2, and in other proper spots, and the illustration of the elements is omitted here.

The ion trap 5 has the configuration of a three-dimensional quadrupole type in which a pair of end cap electrodes 52 and 53 are provided, with a ring electrode 51 between the end cap electrodes 52 and 53, but may be replaced with a linear ion trap or the like as long as ions can be accumulated in the ion trap. Further, the time-of-flight mass separator 6 has an expulsion electrode 61 and a grid electrode 62 as an orthogonal ion accelerating section, and has the configuration in which a reflector 64 composed of a number of reflection electrodes is disposed in a flight space 63, but the time-of-flight mass separator 6 may not be of an orthogonal acceleration type or a reflectron type.

Predetermined voltages are respectively applied by a Q1 drive unit 10 to respective rod electrodes that configure the quadrupole mass filter 2. Predetermined voltages are respectively applied by a CC drive unit 11 to respective rod electrodes that configure the ion guide 4. Predetermined voltages are respectively applied by an IT drive unit 12 to the ring electrode 51 and the end cap electrodes 52 and 53 that configure the ion trap 5. Further, predetermined voltages are respectively applied by a TOF drive unit 13 to the expulsion electrode 61, the grid electrode 62, the reflector 64 and the like included in the time-of-flight mass separator 6. The respective drive units 10, 11, 12 and 13 are controlled by a control unit 20. Further, a detection signal obtained in the ion detector 7 is converted into digital data in an A/D convertor not illustrated and is inputted into a data processing unit 21. The data processing unit 21 includes a mass spectrum creator 22 and the like.

One example of a characteristic operation in the tandem mass spectrometer of the present embodiment is described with reference to FIG. 2 and FIG. 3.

The ion source 1 ionizes various compounds that are contained in the introduced sample, respectively. The produced ions are introduced into the quadrupole mass filter 2. The Q1 drive unit 10 applies, for example, such a voltage that passes only an ion that has a specific mass-to-charge ratio M1 that is predetermined (a voltage in which a direct-current voltage of a predetermined voltage value and a radio-frequency voltage with a predetermined amplitude are superimposed on each other) to the quadrupole mass filter 2. This corresponds to an SIM measurement mode with one channel. Thereby, only the ions having the above-described specific mass-to-charge ratio M1 selectively pass through the quadrupole mass filter 2, and the other ions dissipate.

A CID gas (for example, an inert gas such as helium, and argon) is introduced in the collision cell 3 at a predetermined flow rate, and the ions that pass through the quadrupole mass filter 2 are given collision energy that is determined by a potential difference or the like between the quadrupole mass filter 2 and the ion guide 4 (or an ion injection opening of the collision cell 3), for example, and are introduced into the collision cell 3 as precursor ions. The precursor ions (m/z=M1) contact the CID gas inside the collision cell 3, cause dissociation and are broken down into a plurality of fragments (product ions and neutral loss). As is described later, the pattern of dissociation at this time depends on CID conditions such as the collision energy and CID gas pressure, and when the collision energy is small, dissociation hardly occurs.

The precursor ions that are not dissociated and the product ions produced by dissociation travel while being converged by the action of a radio-frequency electric field that is formed in the ion guide 4 by the voltage applied by the CC drive unit 11. Subsequently, the ions are ejected from the collision cell 3 to reach the ion trap 5. The ions are introduced into the ion trap 5 through an injection hole that is bored in the end cap electrode 52, and are captured by the action of a quadrupole electric field that is formed by the voltage that is applied to the ring electrode 51 by the IT drive unit 12.

As shown in FIG. 2, in the tandem mass spectrometer, the CC drive unit 11 changes the applied voltage to the ion guide 4 (or the ion injection opening of the collision cell 3) so that the collision energy changes to a plurality of stages (four stages that are CE1 through CE4 in this example) during the time period in which the same precursor ions derived from one compound are selectively passed in the quadrupole mass filter 2. The energies that are required to cut various bonded sites in the compound differ respectively, and if the energy that the ions receive when contacting with the CID gas is below the above-described energy, dissociation does not occur. As the collision energy is higher, more bonds that are ordinarily hardly cut are cut, or a plurality of bonds are more easily cut at the same time. Therefore, when the collision energy is switched to the plurality of stages as previously described, the patterns of dissociation of the precursor ions differ respectively under different collision energies, and the kind and the quantity of the produced product ions change.

In the example shown in FIG. 3, the precursor ions are hardly dissociated when the collision energy is CE1 that is the smallest, and most of the ions that pass through the collision cell 3 are precursor ions (m/z=M1). Under CE2 that is the next smallest collision energy, the precursor ions are dissociated, but some of the precursor ions remain as the precursor ions. Further, some of the product ions that are produced by dissociation are only one kind of ions that have a relatively large mass-to-charge ratio. When the collision energy becomes larger to be CE3 or CE4, almost all the precursor ions are dissociated, whereby a plurality of kinds of product ions are produced.

As previously described, when the collision energy changes to CE1→CE2→CE3→CE4, the kind of ions that are ejected from the collision cell 3 is likely to change, and the ion trap 5 accepts and captures all of these ions. Namely, various product ions, that are derived from the same compound and the same precursor ion and are produced under different collision energies, and the precursor ions that are not dissociated are mixed together inside the ion trap 5. Subsequently, after these ions are captured and are subjected to cooling, for example, the ions are injected in a packet form from the ion trap 5 by the direct-current voltage that is applied to the end cap electrodes 52 and 53 by the IT drive unit 12, and are introduced into the ion accelerating section of the time-of-flight mass separator 6.

The TOF drive unit 13 gives an initial energy to the respective ions included in the above-described ion packet respectively and accelerates them in a direction substantially orthogonal to their traveling direction by applying the predetermined voltage to the expulsion electrode 61 and the grid electrode 62 at timing at which the ion packet reaches the ion accelerating section. The accelerated ions are introduced into the flight space 63, fly back by the action of the reflection electric field that is formed by the reflector 64, and finally reach the ion detector 7. The respective ions with substantially the same ion flight starting time points are separated in accordance with the mass-to-charge ratios during flight, and the ions reach the ion detector 7 in such a sequence that the ions with smaller mass-to-charge ratios reach the ion detector 7 earlier. Accordingly, time-of-flight spectrum data that shows the relation of the time of flight and the signal intensity when the time of flight at the ion acceleration time point (namely, the ion flight starting time point) in the ion acceleration section is set as time of flight "0" is inputted into the data processing unit 21 from the ion detector 7.

The ion packet that is ejected from the ion trap 5 is the ion packet where various product ions that are produced under different collision energies and the precursor ions that are not dissociated, both of which are derived from the same compound and the same precursor ion, are mixed, and therefore, the above-described time-of-flight spectrum data also reflects an intensity of such various ions. In the data processing unit 21, the mass spectrum creator 22 performs processing of converting the time of flight into the mass-to-charge ratio and the like for the input time-of-flight spectrum data, and creates a mass spectrum (MS/MS spectrum). Thereby, the MS/MS spectrum in which various product ions that are produced from one kind of precursor ions derived from a certain target compound and the precursor ion itself are reflected is obtained.

Namely, as shown in the MS/MS spectrum at the right end in FIG. 3, the peak of the precursor ion that is only observed when the collision energy is relatively small is observed with a sufficiently large intensity, and peaks of a plurality of kinds of product ions with small mass-to-charge ratios that are observed only when the collision energy is relatively large are also surely observed. These peaks are all peaks of the precursor ions derived from the target compound or the product ions, and since the product ions with different mass-to-charge ratios respectively have different fragment structures, a number of partial structure information that cannot be obtained in an ordinary MS/MS analysis can be obtained in one MS/MS spectrum. By using various kinds of partial structure information like this, estimation of the molecular structure of a compound becomes easy, and the estimation precision is improved. Further, when a compound is unknown, and the compound is to be identified, the identification precision is improved.

Next, a tandem mass spectrometer of the second embodiment of the present invention is described with reference to FIG. 4 and FIG. 5.

Figure 4:
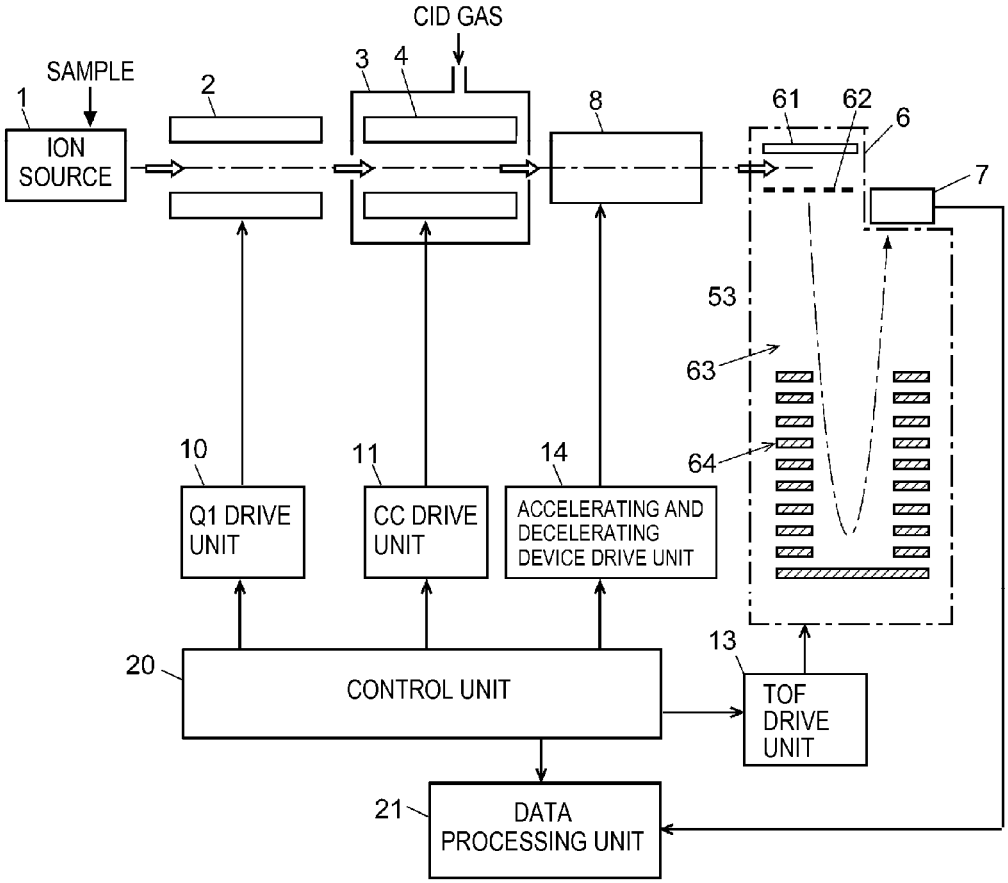
FIG. 4 is a schematic configuration diagram of a tandem mass spectrometer according to a second embodiment of the present invention.

FIG. 4 is a schematic configuration diagram of a tandem mass spectrometer according to the second embodiment. FIG. 5 is a schematic diagram showing schematic operation timings of an operation and processing for ions, of respective units in the tandem mass spectrometer of the second embodiment. The same components identical to those of the tandem mass spectrometer of the first embodiment are denoted by the same numerals.

In the first embodiment, the ion trap 5 is provided between the collision cell 3 and the time-of-flight mass separator 6 as the component corresponding to the ion mixing unit in the present invention, whereas in the second embodiment, an ion accelerating and decelerating device 8 that is driven by an accelerating and decelerating device drive unit 14 is provided in place of the ion trap 5. Only an operation different from that in the aforementioned first embodiment is described.

As in the first embodiment, from the collision cell 3, the product ions that are produced by dissociation of precursor ions under the respective collision energies that are switched to a plurality of stages and the precursor ions that are not dissociated are ejected. The ion accelerating and decelerating device 8 has the function of accelerating and decelerating the ions that pass, at the acceleration degree or the deceleration degree corresponding to the voltage that is applied from the accelerating and decelerating device drive unit 14. As shown in FIG. 5, the accelerating and decelerating device drive unit 14 decelerates ions the most significantly when the initial ion (a precursor ion or a product ion) corresponding to one precursor ion comes out of the collision cell 3 (described by "−" in FIG. 5). As time elapses, the degree of deceleration is made smaller, to the state without acceleration or deceleration (described by "±0" in FIG. 5), and then the ions are accelerated (described by "+" in FIG. 5).

The ions that come out of the collision cell 3 ahead in terms of time are decelerated and the traveling speed is reduced, whereas the ions that come out of the collision cell 3 relatively later in terms of time are decelerated to a low degree or accelerated, and therefore, the traveling speed becomes higher as compared with that of the ions ahead of them. Therefore, although there is a time difference when the ions come out of the collision cell 3, by appropriately adjusting the degree of deceleration or acceleration of ions by an ion accelerating and decelerating device 8, all the ions derived from the same target compound and derived from the same precursor ions are introduced into the ion accelerating section of the time-of-flight mass separator 6 gather to a certain extent, namely, in the state in which all the ions get together to such an extent that all the ions are regarded as in a packet form. Namely, in the first embodiment, the various product ions that are produced under the different collision energies and the precursor ions that are not dissociated, both of which are derived from the same compound and the same precursor ions, are mixed together inside the ion trap 5, whereas in the second embodiment, these ions are mixed together at the point of time when these ions are introduced into the ion accelerating section of the time-of-flight mass separator 6. Thereby, in the tandem mass spectrometer of the second embodiment, the MS/MS spectrum in which the precursor ions and various product ions are reflected can be acquired as well as in the first embodiment, and precision of structure analysis and identification is improved.

Note that in the above-described first and second embodiments, the different CID conditions, namely, the different collision energies of the plurality of stages can be set in advance, and in some cases it is found out that depending on the kind of compounds, product ions that are significant, namely, having a sufficiently high signal intensity cannot be obtained with a certain energy among the preset stages. In that case, it can be said as useless to collect ions that are produced by dissociation of precursor ions under such a collision energy, and therefore, the ion dissociation operation under the collision energy can be omitted.

Figure 5:
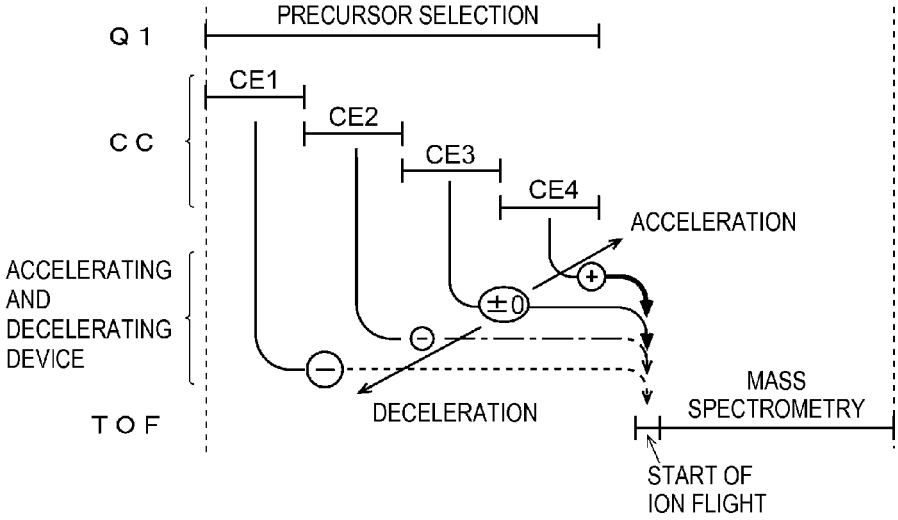
FIG. 5 is a schematic diagram showing schematic operation timings of an operation and processing for ions of respective units in the tandem mass spectrometer of the second embodiment.

For example, in the examples shown in FIG. 2, FIG. 3 and FIG. 5, the ion dissociation operations under the collision energies of the four stages of CE1 through CE4 are carried out, but when it is found out that a significant product peak cannot be obtained under the collision energy CE3 for a certain compound, setting can be made so as to perform an ion dissociation operation of only the three stages of the collision energies CE1, CE2 and CE4 for the compound. The spare time may be used in reduction of the analysis time, or may be spent for the ion dissociation operations with the collision energies CE1, CE2 and CE4. The method that limits the collision energy in response to the kind of the compound to be analyzed in this manner is effective especially in performing screening or the like of the known compounds efficiently or precisely.

Further, in the first and second embodiments, the CID condition for one precursor ion is switched to the plurality of stages for one target compound, and various ions that are collected at that time are subjected to a mass spectrometry to create one MS/MS spectrum, but instead of the SIM measurement mode of one channel like this, the quadrupole mass filter 2 may be driven in an SIM measurement mode of multiple channels, and various ions that are collected at this time may be subjected to a mass spectrometry to create one MS/MS spectrum. Namely, in one MS/MS spectrum, the peaks of a plurality of precursor ions with different mass-to-charge ratios and the product ions produced from the precursor ions may coexist.

In this case, if the MS/MS spectrum obtained by synthesizing the MS/MS spectra in which the product ions derived from a plurality of precursor ions are reflected respectively is set as a reference MS/MS spectrum for structure analysis and identification, accurate structure analysis and identification can be performed even if a spectrum pattern itself becomes complicated.

Further, by reducing the mass resolution intentionally at the time of selecting precursor ions in the quadrupole mass filter 2, wide variety of precursor ions of not only a target compound composed of only stable isotopes but also a target compound differing in mass because of including isotopes other than stable isotopes may be included in the precursor ions, and product ions obtained when the CID condition is changed for such precursor ions may be collectively subjected to a mass spectrometry.

Note that the above-described embodiments and modifications are mere examples of the present invention. It is evident that any modification, addition or correction appropriately made within the spirit of the present invention, other than described above, will fall within the scope of the appended claims of the present application.

EXPLANATION OF NUMERALS

1 . . . Ion Source
2 . . . Quadrupole Mass Filter

3 . . . Collision Cell
4 . . . Ion Guide
5 . . . Ion Trap
51 . . . Ring Electrode
52, 53 . . . End Cap Electrode
6 . . . Time-of-Flight Mass Separator
62 . . . Grid Electrode
63 . . . Flight Space
64 . . . Reflector
7 . . . Ion Detector
8 . . . Ion Accelerating and Decelerating Device
10 . . . Q1 Drive Unit
11 . . . CC Drive Unit
12 . . . IT Drive Unit
13 . . . TOF Drive Unit
14 . . . Accelerating and Decelerating Device Drive Unit
20 . . . Control Unit
21 . . . Data Processing Unit
22 . . . Mass Spectrum Creator

The invention claimed is:

1. A tandem mass spectrometer including an ion source that ionizes a compound in a sample, a first mass separating unit that selects an ion having a specific mass-to-charge ratio in various produced ions as a precursor ion, an ion dissociating unit that dissociates the precursor ion, and a second mass separating unit and a detector that perform a mass spectrometry of various product ions that are produced by the dissociation, the tandem mass spectrometer comprising:

a) an ion mixing unit that is placed between the ion dissociating unit and the second mass separating unit, and adjusts traveling of ions so that ions are mixed together at least at a time point when the ions are introduced into the second mass separating unit, with respect to various ions ejected from the ion dissociating unit at different timings;

b) an analysis controlling unit that switches a condition under which the ion is dissociated in the ion dissociating unit from one to another, and controls an operation of the ion mixing unit so that the ions ejected from the ion dissociating unit during a time period of the switch are mixed together at least at the time point when the ions are introduced into the second mass separating unit; and c) a data processing unit that acquires a mass spectrum based on a detection signal that is obtained by the second mass separating unit and the detector in a predetermined mass-to-charge ratio range during the time period of switching the dissociation condition by the analysis controlling unit.

2. The tandem mass spectrometer according to claim 1, wherein the ion mixing unit is an ion trap that temporarily traps ions.

3. The tandem mass spectrometer according to claim 1, wherein the ion mixing unit performs either acceleration or deceleration, or both, to ions.

4. The tandem mass spectrometer according to claim 1, wherein the analysis controlling unit executes switching of the dissociation condition when driving the first mass separating unit in a selected ion monitoring measurement mode with one or a plurality of precursor ions as a target.

5. The tandem mass spectrometer according to claim 1, the tandem mass spectrometer further comprising:

a condition setting unit for setting in advance the dissociation condition that is switched from one to another in the analysis controlling unit in accordance with a compound to be analyzed.

6. The tandem mass spectrometer according to claim 1, wherein the dissociation condition is a collision energy that is given to a precursor ion, and the analysis controlling unit switches the collision energy to a direction to be larger in sequence from a small energy.

7. A mass spectrometric method that uses a tandem mass spectrometer including an ion source that ionizes a compound in a sample, a first mass separating unit that selects an ion having a specific mass-to-charge ratio in various produced ions as a precursor ion, an ion dissociating unit that dissociates the precursor ion, and a second mass separating unit and a detector that perform a mass spectrometry of various product ions that are produced by the dissociation, the method comprising:

a) an ion mixing step of adjusting traveling of ions so that when a condition in which the ions are dissociated is switched from one to another in the ion dissociating unit, the ions that are ejected from the ion dissociating unit at different timings during a time period of the switch are mixed together at least at a time point when the ions are introduced into the second mass separating unit; and b) a data processing step of acquiring a mass spectrum based on a detection signal that is obtained by the second mass separating unit and the detector, in a predetermined mass-to-charge ratio range, with respect to the ions that are introduced into the second mass separating unit in a mixed state in the ion mixing step, during the time period of switching the dissociation condition in the ion dissociating unit.

* * * * *